US007874886B2

(12) United States Patent
Fowler et al.

(10) Patent No.: US 7,874,886 B2
(45) Date of Patent: Jan. 25, 2011

(54) COMMUNICATION FLOAT

(75) Inventors: George Fowler, Dartmouth (CA); Greg Siddall, Dartmouth (CA); Brian Beanlands, Glen Haven (CA)

(73) Assignee: Her Majesty in the right of Canada as represented by the Department of Fisheries and Oceans, Ottawa (CA)

( * ) Notice: Subject to any disclaimer, the term of this patent is extended or adjusted under 35 U.S.C. 154(b) by 324 days.

(21) Appl. No.: 12/149,132

(22) Filed: Apr. 28, 2008

(65) Prior Publication Data

US 2009/0269709 A1 Oct. 29, 2009

(51) Int. Cl.
*B63B 22/00* (2006.01)

(52) U.S. Cl. ..... 441/11; 367/4

(58) Field of Classification Search ..... 441/1, 441/11, 21, 23, 26, 28; 367/3, 4
See application file for complete search history.

(56) References Cited

U.S. PATENT DOCUMENTS 3,329,015 A * 7/1967 Bakke et al. ..... 441/11
3,354,860 A * 11/1967 Dale et al. ..... 367/3
3,372,368 A * 3/1968 Dale et al. ..... 367/12
3,506,841 A * 4/1970 Majkrzak ..... 441/11
3,590,408 A * 7/1971 Verhagen ..... 441/23
3,754,439 A * 8/1973 Bauer ..... 73/170.16
3,772,639 A * 11/1973 Snyder ..... 367/4
4,186,370 A * 1/1980 Cupolo et al. ..... 441/11
4,193,057 A * 3/1980 Bennett et al. ..... 441/11
4,557,608 A * 12/1985 Carver ..... 441/11
4,853,900 A * 8/1989 Snyderwine ..... 441/1
H1051 H * 5/1992 Briguglio ..... 441/28
6,397,510 B1 6/2002 Klein
6,463,800 B2 10/2002 Fowler
7,226,328 B1 * 6/2007 Puzella et al. ..... 441/11

* cited by examiner

*Primary Examiner*—Lars A Olson
(74) *Attorney, Agent, or Firm*—Ronald G. Bitner

(57) ABSTRACT

A communication float for an oceanographic instrument, such as a profiler, comprising an elongated buoyant float, connected at one to the instrument by means of a neutrally buoyant communication cable, and having an antenna mounted on the other end. The float is ballasted to float at an angle such that the antenna extends from the water when the float is on the surface of the water, and whereby the float is oriented substantially vertically when submerged. The communication float is configured to provide minimal effects on the profiler instrument for either the submerged or floating mode, and to maintain transmission while subjected to wave action on the ocean.

3 Claims, 2 Drawing Sheets

COMMUNICATION FLOAT

FIELD OF THE INVENTION

This invention relates to a communication float system for the telemetering of data from a subsurface oceanographic mooring.

BACKGROUND OF THE INVENTION

Current ocean science requires real or near real time subsurface data to support models of ocean processes. Parameters such as temperature and salinity, among many others, may be monitored by instruments mounted on oceanographic moorings. To enhance system survivability these moorings are frequently of subsurface design having no surface expression. Instruments may be mounted in fixed positions but an increasingly common method for obtaining such data involves moving, or profiling, instruments through the water column to obtain profiles of oceanographic conditions. Since the desired sites for these data are frequently far from shore, some form of communication link, typically via satellite, is required. The problem with known systems is the secure and stable intermittent maintenance of an antenna above an unstable sea surface at a fixed mooring site using a surface buoy while at the same time ensuring that the surface expression does not compromise the scientific data being collected, or interfere with the performance of the subsurface portion of a mooring or profiling system.

Simply placing an antenna on the top of an intermittently surfacing element is not a viable option when working in a moored configuration. The transmission of data from the subsurface portion of a mooring is problematical when the surface of the ocean is perturbed by waves. Because of wave forcing, it is difficult to avoid submergence of the data transmitting element resulting in interruption of transmission. With any significant wave height, the antenna has to become inordinately large because the transmitting element is subjected to inertial forces caused by interaction of the orbital motion of the water and the transmitting element's self and virtual mass. These forces are transient in nature and can give rise to snap loadings that may have deleterious effects on all components of the mooring's system.

As a specific example, U.S. Pat. No. 6,463,800 discloses a moored buoyant ocean profiler that includes a counterbalancing buoyant member for conserving energy as the instrument carrying buoyant member is raised and lowered. In this particular case, when the instrument carrying buoyant member is raised for transmission into the wave zone the balance of the profiler drive system, upon which the energy efficient system relies, can be upset.

The approach developed to overcome these obstacles, including the energy conserving system described above, was to provide a separate communication float connected to the instrument carrying submerged buoy by a flexible line.

U.S. Pat. No. 6,397,510 discloses a fishing bobber with strike-indicating radio transmitter for transmitting a radio signal to the fisherman when there is a strike on the line. Although one embodiment of this patent shows separate transmitter float for communication purposes, the arrangement as shown is not intended for, nor, would it be suitable for meeting the requirements of the present invention, such as when it subjected to wave action on the ocean.

SUMMARY OF THE INVENTION

An object of the present invention is to provide subsurface moorings and moored ocean profiling systems with improved communication components for the transmission of data.

The present invention provides a communication float for an oceanographic instrument, comprising a buoyant float having an elongated shape defining a longitudinal axis; said float having a first end connected to the instrument by means of a communication cable; an antenna operatively connected with said communication cable mounted on the other end of said float; said float being ballasted near said first end to float with the longitudinal axis slanted at a near horizontal orientation such that the antenna extends from the water when the float is on the surface of the water, and whereby the longitudinal axis of the float takes assumes a substantially vertically orientation when submerged.

DESCRIPTION OF THE PREFERRED EMBODIMENTS

Figure 1:
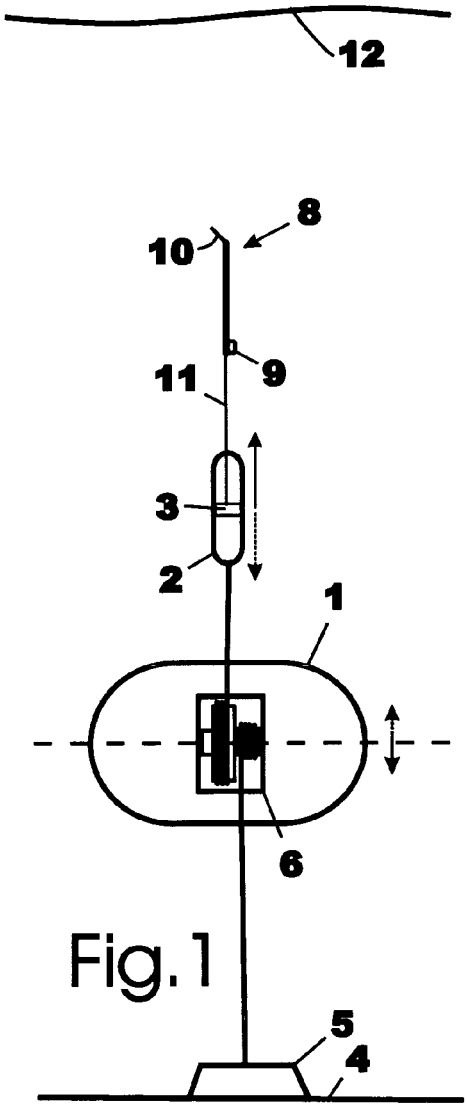
FIG. 1 is a schematic representation of a profiling system which shows the communication float of the present invention submerged, as in the profiling data acquisition mode.
Figure 2:
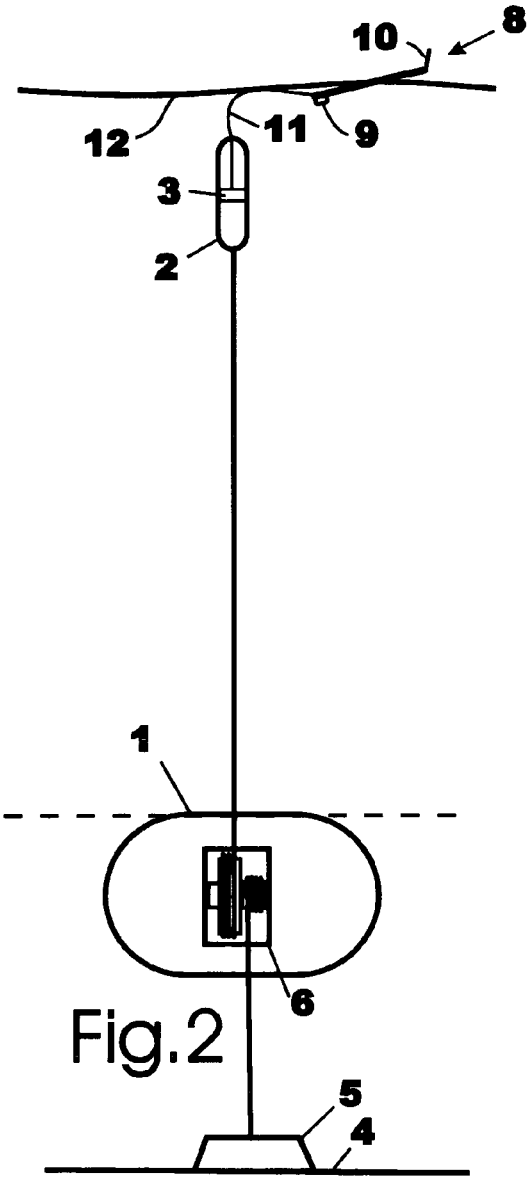
FIG. 2 is a schematic representation of a profiling system which shows the communication float of the present invention floating on the surface, as in the data transmission mode.

FIGS. 1 and 2 show schematically one type of profiling system, specifically an energy balanced system, which incorporates the communication float of the present invention. The profiling system includes two counterbalanced buoyant members 1 and 2, interconnected by a suitable line 2. The buoyant members 1 and 2 are shown moored to the ocean bottom 4 by a suitable anchor 5. Profiling instrumentation 13 is carried by a vertically traversing buoyant member 3 of low buoyancy which is interconnected by suitable drive means 6 with a buoyant member 1 of relatively high buoyancy to travel in the opposite direction at lesser distance, as can be seen with respect to reference line 7. With this arrangement the potential energy of one buoyant member is increased as the potential energy of the other is decreased, thereby conserving energy as the instrument 3 carrying buoyant member 2 is raised and lowered. U.S. Pat. No. 6,463,800 discloses details of one embodiment of such an energy conserving profiling system.

Connected by communication cable 11 to the instrument carrying buoyant member 2 is a communication float 8 which is described in detail below. FIG. 1 shows the profiling system with the instrument 3 carrying buoyant member 2 in the vertically traversing, or profiling data acquisition mode. FIG. 2 shows the profiling system with the instrument carrying buoyant member 2 near the surface and the communication float 8 floating on the water surface for data transmission.

Figure 3:
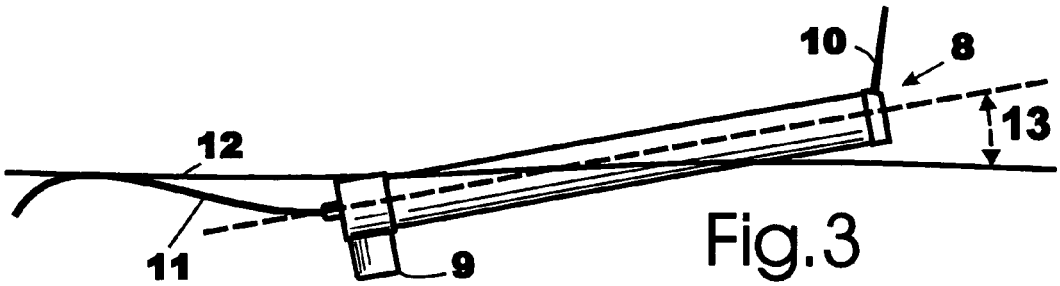
FIG. 3 is an enlarged view showing details of the communication float.

With specific reference to FIG. 3, the communication float 8 is shown in the form of an elongated buoyant cylinder. The communication float 8 should be small and have low buoyancy, relative to that of the buoyant member 2, to minimize wave forcing effects or changing the profiling system's balance upon surfacing. One end of the float is connected to the instrument 3 by means of a communication cable 11. The cable 11 will preferably have substantially neutral buoyancy to minimize adverse forces. An antenna 10 is mounted on the other end of the communication float 8. The float 8 is ballasted to float on the surface of the water with the longitudinal axis at an angle 13 such that the antenna extends from the water. Ballasting of the float is shown provided by a keel mass 9, positioned diametrically opposite to that of the antenna, which provides for both the near horizontal floating attitude and also roll stability to maintain the antenna above water.

In the profiling mode of operation, as shown in FIG. 1, the submerged communication float 8 will have a substantially vertical orientation, which minimizes the unbalancing drag forces applied to the profiling system. Preferably the communication float will have a small cross-section in order to minimize drag forces.

Optimization of float configuration involves consideration of resistance to submergence and stability. These are related to buoyancy, and the geometry of the buoyancy of the float.

The resistance to submergence of a floating body is a function of the water plane area of the body; the higher this area, the greater the resistance to submergence. When the float is floating in a near horizontal orientation, the water plane is an ellipse whose area ($\pi bh/4$, where b and h are minor and major diameters respectively) is approximately six times that of a float with cylindrical cross section having a diameter equal to the minor diameter of the ellipse (i.e. the same cylinder floating vertically).

The stability of a floating body is also dependent upon the water plane; however, in the formulas developed to describe stability it is not just simply the water plane area that is employed but rather the "Second Moment of Area" ($\pi bh^3/64$). This value for the elliptical water plane surface of the communication float is almost 200 times that of a float with cylindrical cross section having a diameter equal to the minor diameter of the ellipse. The Second Moment of Area is used to calculate other parameters which give a gauge of buoy stability and so the high ratio given should be accepted only as a guide to stability improvement rather than an absolute measure.

The above applies to stability in the "fore and aft" or pitch direction. Just as important, but not subject to the same forcing from the mooring attachment, is the roll stability. Here, the keel mass 9 attached to the front of the float ensures that the antenna remains more or less vertical. If the float moves toward the vertical, due to wave forcing, the restoring force of the keel in the roll direction is reduced, but when the antenna is well clear of the water the need for roll stability is also reduced. As the float returns to the horizontal position the influence of the keel becomes more important in keeping the antenna vertical. The value of the restoring force as the float transitions from vertical to horizontal is such that the float takes up a "lazy" attitude so there are no snap loads applied to the attachment cable 11.

The arrangement of the ballast on the float confers automatic antenna orientation to the upright position while resisting antenna submergence beneath the waves. If the float is pushed up into the air by the moment created by tether and buoyancy forces as a wave passes it tends to linger because of small restoring forces associated with its compact size. When the float is pushed or pulled down into the water by similar but opposite forcing it tends to tilt creating a large water plane area to resist submergence. The float does all this without requiring any kind of input power or sensing of antenna attitude. Its small size means that it does not induce large forces on any part of the system to which it is attached.

The drag forces applied to the float arise from the relative movement of water flowing past the float and are a function of the frontal area of the float presented perpendicular to the flow and the cross-sectional shape of the float presented parallel to the flow. For the present communication float the ratio of frontal area between it and a cylindrical spar buoy is around 0.27. In addition to this reduction of drag when the buoy tilts, the float changes shape from a circle to an ellipse with a resultant reduction in drag coefficient from about 1.2 to about 0.3 (for an infinitely long circular or elliptical cylinder). Combining the two effects, the drag is reduced to about 0.8 or about a factor of 12. Basically, the small size and shape of the float reduces the forces that tend to sink the float. The smaller forces also mean that the potential for mechanical damage is reduced.

By using a neutrally buoyant cable between the submerged sensor float and the communication float, the cable loading is essentially along the axis of the buoy which dramatically reduces bending and associated stresses in the cable as would be seen in a spar buoy. For buoys on the surface, cable damage due to bending is the most common mode of failure. While keeping a buoy on the surface permanently can be difficult in storm conditions, and may lead to premature failure, the small size, mass and configuration of the present communication float mean that it has excellent survival potential.

A communication float found to be suitable was constructed as follows:

Length (overall)=43.5 in
Length (pressure case)=40.0 in
Diameter (pressure case)=3.56 in
Weight (in air)=Floating Buoyancy=11.6 lb
Floating Trim Angle=10 degrees from horizontal
Reserve Buoyancy=4.10 lb
Antenna Length (from centre line)=10.0 in
Payload (antennae, radio & mount)=1.48 lb
Payload Moment Arm=5.00 in
Keel Weight (in air)=3.10 lb
Keel Moment Arm=4.70 in
Aspect Ratio=length/dia=11
Payload Ratio=payload/weight=0.13
Reserve Buoyancy Ratio=reserve/floating=reserve/weight=0.35
Torque-Roll Ratio=payload/keel=1.48×5.00/3.10×4.70=0.51

As indicated above, the communication float was tested and operated successfully with a floating angle slanted 10 degrees from horizontal. It appears that a floating angle of 15 degrees or less, and particularly from 5 to 15 degrees, would be suitable.

The communication float is preferably connected to the instrument float by means of neutrally buoyant cable. The cable may be rendered neutrally buoyant through the incorporation of low specific gravity components in the cable, or by the addition of small floats distributed along its length and capable of withstanding the pressure to which the system will be subjected when submerged.

It will be understood that the communication float of the present invention may have a configuration different from that illustrated herein. Also, this communication float can be used for various types of oceanographic instruments. FIGS. 4 to 7 show examples of other systems using the present communication float.

Figures 4, 5, 6, 7:
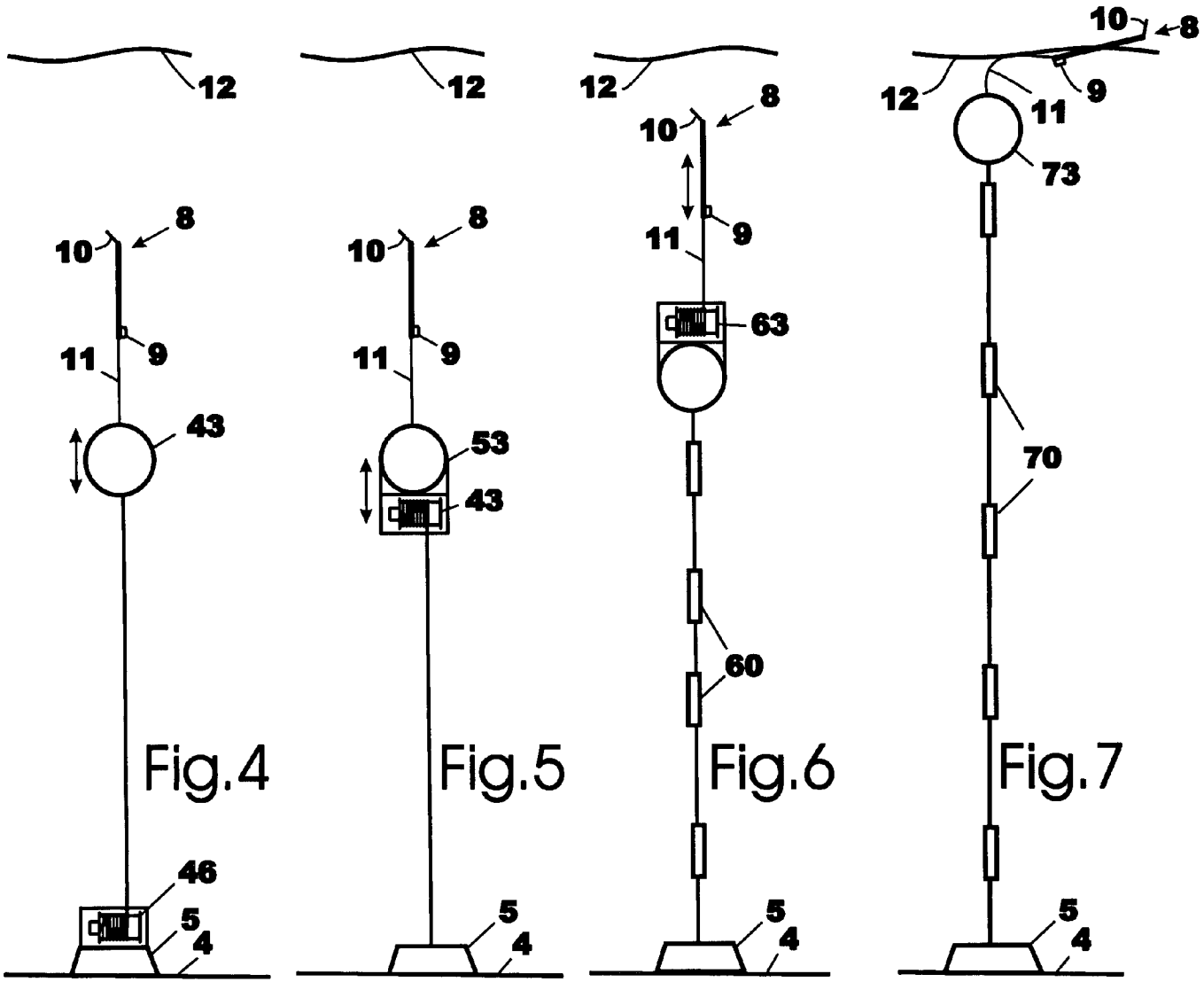
FIG. 4 is a schematic representation of a profiling system using a bottom mounted winch for traversing an instrument/buoyancy pod.
FIG. 5 is a schematic representation of a profiling system using an instrument/buoyancy pod with onboard winch.
FIG. 6 is a schematic representation of a profiling system using fixed instruments and winched communication float.
FIG. 7 is a schematic representation of a profiling system using fixed instruments and permanently deployed communication float.

FIG. 4 shows a profiling system using a bottom mounted winch 46 for traversing an instrument/buoyancy pod 43. For transmitting data the pod is raised to near the surface such that the communication float 8 floats on the surface, as shown in FIG. 2.

FIG. 5 shows a profiling system similar to that shown in FIG. 4 in which the instrument/buoyancy pod 53 is provided with an onboard winch 43.

FIG. 6 shows a system using fixed instruments 60 and winch 63 for manipulating the communication float 8.

FIG. 7 shows a system using fixed instruments 70 and permanently deployed communication float 8.

The invention claimed is:

1. A communication float for an oceanographic instrument, comprising a buoyant float having an elongated shape defining a longitudinal axis;

said float having a first end connected to the instrument by means of a communication cable;

an antenna operatively connected with said communication cable mounted on the other end of said float;

ballast means comprising a keel mass disposed diametrically opposite to that of the antenna for biasing the antenna out of the water, and disposed near said first end such that said float floats with the longitudinal axis slanted at a near horizontal orientation at an angle of from 5 to 15 degrees from horizontal such that the antenna extends from the water when the float is on the surface of the water, and whereby the longitudinal axis of the float assumes a substantially vertically orientation when submerged.

2. The apparatus of claim 1, wherein the communication cable has substantially neutral buoyancy.

3. The apparatus of claim 1, wherein the float is ballasted to float with the longitudinal axis at an angle of about 10 degrees from horizontal.

* * * * *